US005555612A

United States Patent [19]

Biondo

[11] Patent Number: 5,555,612

[45] Date of Patent: Sep. 17, 1996

[54] EXTERNALLY REMOVABLE TWIST LOCKING CASKET HARDWARE

[75] Inventor: John P. Biondo, Batesville, Ind.

[73] Assignee: Batesville Casket Company, Inc., Batesville, Ind.

[21] Appl. No.: 365,211

[22] Filed: Dec. 28, 1994

[51] Int. Cl.[6] ..... A61G 17/00

[52] U.S. Cl. ..... 27/2; 27/1; 27/27; 16/112

[58] Field of Search ..... 27/1, 2, 27, 35; 16/112, 114 R, DIG. 24, DIG. 40; 403/348, 349

[56] References Cited

U.S. PATENT DOCUMENTS

| | | | |
|---|---|---|---|
| 2,784,995 | 3/1957 | Hawkins | 16/114 R |
| 4,697,316 | 10/1987 | Semon | 27/1 |
| 5,144,727 | 9/1992 | Craft . | |
| 5,241,729 | 9/1993 | MacKirdy | 27/2 |
| 5,377,395 | 1/1995 | Maier et al. . | |

*Primary Examiner*—Kien T. Nguyen
*Attorney, Agent, or Firm*—Wood, Herron & Evans

[57] ABSTRACT

Hardware for a casket which may be quickly and easily twisted into fixed engagement with the casket at a predetermined orientation. The hardware may be easily removed from the casket without leaving metal hardware components in or on the casket. Specifically, an anchor member is fixed to the casket and comprises a twist locking connector which mates with a twist locking connector fixed to an item of casket hardware. The item of hardware preferably comprises a casket handle or other handle component such as a handlebar mount. The twist locking connectors of the anchor member and the item of casket hardware include stop surfaces which engage during a twisting motion of the item of casket hardware. This twisting motion is preferably less than a full turn of the item of casket hardware.

27 Claims, 2 Drawing Sheets

EXTERNALLY REMOVABLE TWIST LOCKING CASKET HARDWARE

FIELD OF THE INVENTION

The present invention generally relates to a casket and, more specifically, to hardware mounted externally to a casket for aesthetic and functional purposes.

BACKGROUND OF THE INVENTION

Caskets made from wood generally have included metallic hardware for such purposes as providing mounting supports for a handlebar on each side of the casket. The hardware is usually ornamental to at least some extent to provide aesthetic qualities in addition to its functional considerations. In this latter regard, the hardware must provide enough strength and support to carry the full weight of the casket when the handlebars on both sides are lifted and the casket is transported or maneuvered.

Generally, casket hardware is fastened from inside the casket and, when the casket lid has been closed and locked after a funeral or memorial service, it cannot be opened to access the hardware fasteners on the inside. Thus, caskets have generally been cremated with the hardware still in place. However, metallic hardware causes certain problems during the cremation of wooden caskets. Moreover, as cremation is becoming increasingly popular, these problems have become an increasing concern in the industry.

Certain problems stem from the zinc which is often included as a major component in metallic casket hardware. Over time, zinc can damage and deteriorate the fire brick of the crematory. Also, melting and decomposition of the zinc during the cremation process can yield undesirable gases. Stamped steel casket hardware which cannot be removed prior to cremation also presents problems. During the cremation of caskets having this type of hardware, the steel generally does not melt during the cremation process but does sear to such incidental human remains as bone fragments. There are also the problems of removing such stamped steel hardware from the remains while it still may be hot and of disposing of such hardware. Needless to say, casket hardware which has been through the cremation process is not readily usable as casket hardware again.

One solution to the problems mentioned above is provided in co-pending and commonly assigned U.S. Pat. No. 5,377,395. In that patent, a hardware assembly is disclosed which includes a bolt held in place by a plastic nut assembly contained inside the casket. A pin extends through the bolt and may be actuated by a tool from outside the casket to release the plastic nut assembly from the bolt. The plastic nut assembly falls to the bottom of the casket and is readily destroyed by the cremation process. All of the external hardware is then removable and may be readily used on another casket. Although this hardware is vastly improved over past hardware assemblies in many ways, it does have the drawback of generally necessitating the use of a tool to actuate the pin and release the plastic nut assembly.

Also, casket hardware has been generally cumbersome to assemble and fasten to the casket. In this regard, some hardware requires maintaining proper orientation of the item of hardware, such as a casket handle or handlebar mount, as it is being fastened to the casket with fasteners, such as nuts and bolts, which require the use of tools. While past mounting procedures required for casket hardware have generally been adequate, it has become apparent that further improvements in this regard would be desirable.

SUMMARY OF THE INVENTION

It has therefore been one objective of the present invention to provide casket hardware which may be easily removed from the casket without opening the casket lid.

It has been another object of the invention to provide casket hardware which is quickly attached and removed without the use of tools.

It has been yet another object of the invention to assure positive locking of hardware components to a casket at a predetermined proper orientation with only a short twisting motion.

To these ends, the present invention provides hardware for a casket which may be quickly and easily twisted into fixed engagement with the casket at a predetermined orientation and may be disconnected without accessing the interior of the casket. Specifically, an anchor member is fixed to the casket and includes a twist locking connector which mates with a twist locking connector fixed to an item of casket hardware. The item of hardware preferably comprises a casket handle or other handle component such as a handlebar mount. For a handle, the predetermined orientation is one in which the handle is disposed in a normal horizontal orientation. The twist locking connectors of the anchor member and the item of casket hardware include stop surfaces which engage during a twisting motion of the item of casket hardware. This twisting motion is preferably less than a full turn of the item of casket hardware.

In the preferred embodiment, the anchor member is a generally tubular member which is preferably formed from a suitable high strength plastic material. The anchor member is securely held in a recess or hole contained in the casket. As it is formed from plastic, the anchor member may be left attached to a wooden casket during cremation whereupon it will be destroyed. The anchor member includes an inner, semi-cylindrical hollow space within one half thereof and a semi-cylindrically shaped element rigidly affixed in the other half thereof but spaced from an inner wall of the anchor member to define a curved slot having a stop surface at one end. The twist locking connector of the item of casket hardware is a male member taking the form of a hollow semi-cylindrical element sized to be received within the semi-cylindrical space of the anchor member and twisted into a locked position within the curved slot. One edge of the hollow semi-cylindrical element defines a stop surface for engaging the stop surface at the end of the curved slot.

The respective twist locking connectors further include surfaces which interfere with one another during the twisting motion such that, at the end of the twisting motion, the item of casket hardware is effectively held or locked in the proper predetermined orientation. In the preferred embodiment, these interfering surfaces comprise an inside end surface of the hollow semi-cylindrical element and an outside surface of the semi-cylindrical element within the anchor member. Each of these surfaces are cam or wedge surfaces that engage each other with a tight frictional fit during the twisting motion to effectively lock the two connecting elements together at the predetermined orientation defined by the respective stop surfaces.

The twist locking casket hardware of the present invention allows a quick, strong connection to be made with a casket without the necessity of tools. The casket hardware, such as a casket carrying handle, is in a proper and positively defined locked position at the end of the short twisting motion thereof. Moreover, the hardware of the present invention may be easily twisted off the casket without accessing the interior of the casket.

Further objects and advantages of the invention will become more readily apparent from the following detailed description of a preferred embodiment thereof taken in conjunction with the accompanying drawings.

DETAILED DESCRIPTION OF THE PREFERRED EMBODIMENT

Figure 1:
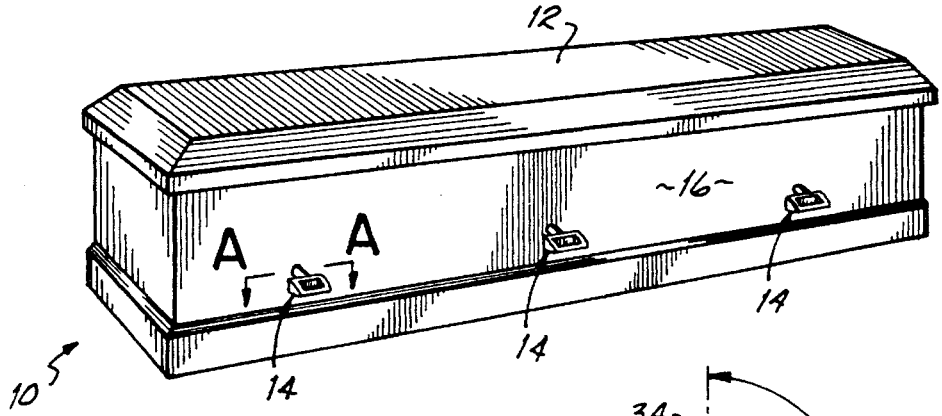
FIG. 1 is a perspective view of a casket including casket handles constructed in accordance with the present invention.

Referring first to FIG. 1, a casket 10 is illustrated which generally includes a lid 12 and a plurality of items of casket hardware 14 affixed in accordance with the present invention to one side 16 of casket 10. In this specific embodiment, casket hardware 14 comprises a plurality of casket handles, however, it will be appreciated that the present invention is also applicable to other items of casket hardware, such as handlebar mounts. Although not shown in FIG. 1, the same number of casket handles 14 are also affixed at corresponding locations on the other side of casket 10.

Figure 2:
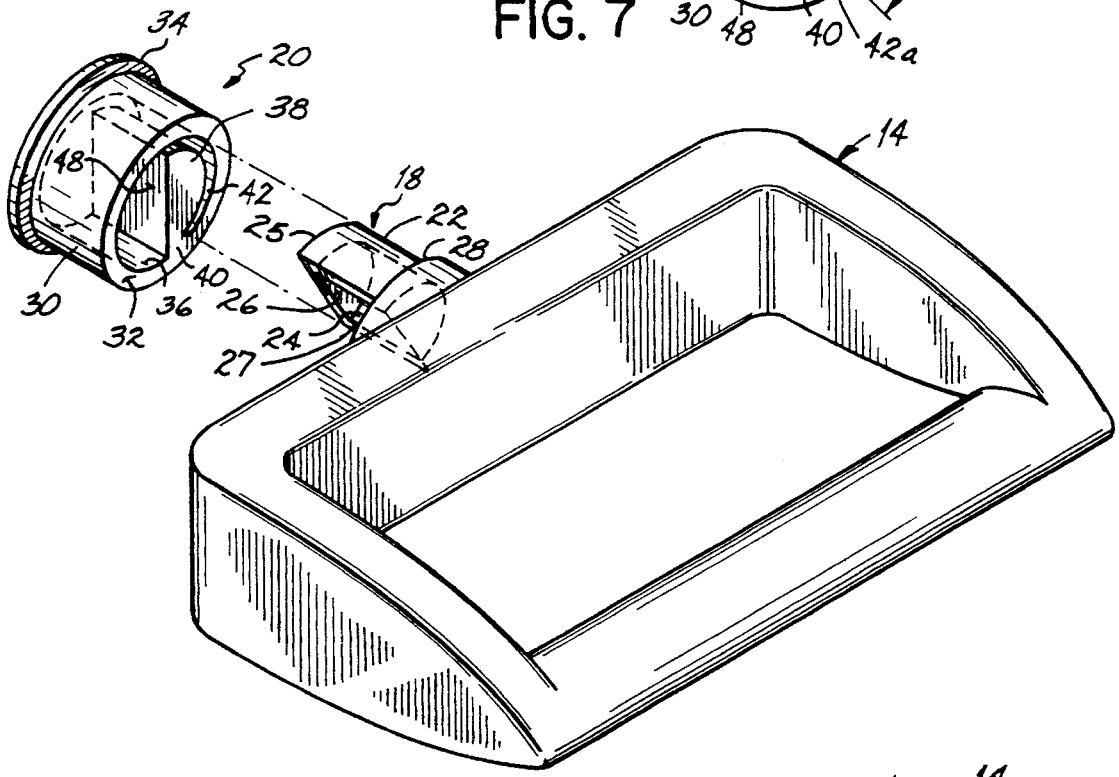
FIG. 2 is an exploded perspective view of a casket handle and associated anchor member of the invention.

Referring now to FIG. 2, casket handle 14 includes a twist locking connector 18 rigidly secured to one side thereof. Twist locking connector 18 is preferably a hollow, semi-cylindrical member which is adapted to mate in a short twisting motion to an anchor member 20 when anchor member 20 is rigidly secured within a hole or recess in side 16 of casket 10 (FIG. 1). Handle 14, connector 18 and anchor member 20 are all preferably formed from a high strength plastic or resin material. For wooden caskets 10, anchor member 20 is formed from a plastic material since it will remain connected to side wall 16 during cremation whereupon it will be readily destroyed. Anchor member may be handle 14 or other hardware used with the connection system of this invention may be formed of metal or have metal components since these items are easily removed before cremation without opening casket 14.

Connector 18 specifically includes an outer semi-cylindrical surface 22 and an inner semi-cylindrical space 24 bounded by two closed ends, with one end 25 including an inner cam or wedge surface 26 for reasons to be discussed below. One longitudinal edge 27 of connector 18 acts as a stop surface when connector 18 is connected in a twisting motion to anchor member 20 as will also be detailed below. An outer abutment 28 disposed between connector 18 and handle 14 provides a further stop surface for limiting insertion of connector 18 into anchor member 20.

Figure 4:
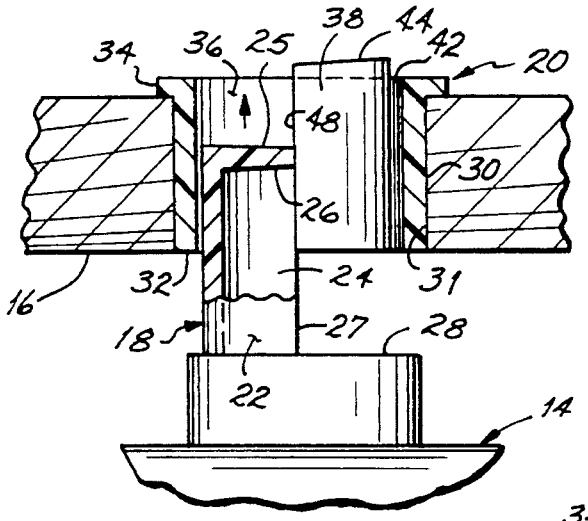
FIG. 4 is a cross-sectional view taken generally along line A—A of FIG. 1 and showing the insertion of the casket handle twist locking connector into the anchor member.
Figure 5:
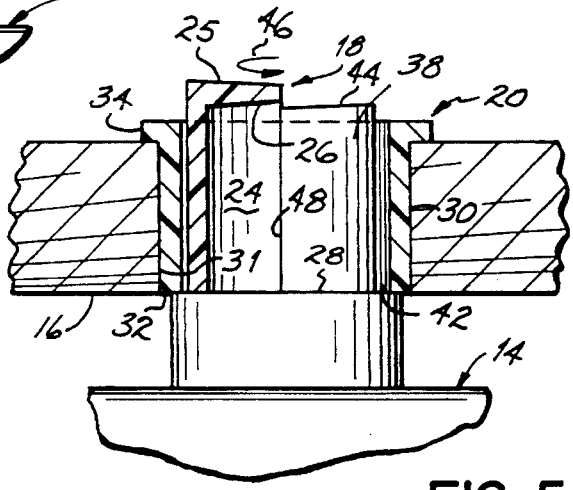
FIG. 5 is a cross-sectional view taken generally along line A—A of FIG. 1 and showing the twist locking connector of the casket handle fully inserted into the anchor member.
Figure 6:
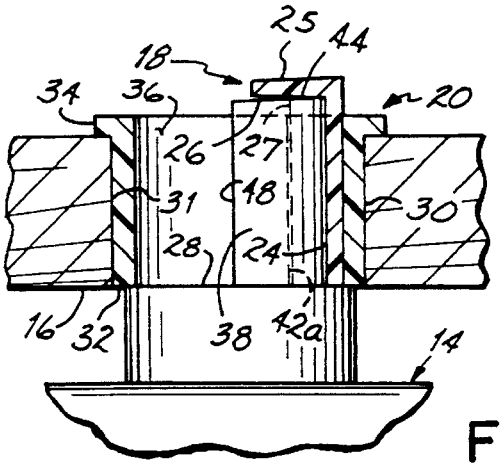
FIG. 6 is a cross-sectional view taken generally along line A—A of FIG. 1 and showing the casket handle twisted with respect to the anchor member into a fully engaged and locked position.

As further shown in FIG. 2, anchor member 20 is generally shaped as a tubular element and, more specifically, as a cylindrical element having an outer cylindrical surface 30. One annular end surface 32 provides an abutment for engaging abutment 28 during the insertion of connector 18 into anchor member 20. The opposite end of anchor member 20 includes an outwardly extending flange 34 which provides a positive stop when anchor member 20 is inserted into a hole 31 in casket wall 16 (FIGS. 4–6). An inside portion of anchor member 20 includes a semi-cylindrical hollow space defined by inner wall 36 and sized to receive the semi-cylindrical connecting element 22 in a sliding manner. In another half of anchor member 20, a solid semi-cylindrical element 38 is rigidly affixed to inner wall surface 36 along a lengthwise connection area 40. As shown best in FIG. 7, element 38 is spaced from inner wall surface 36 along one side to define a curved slot 42 having a closed end defining a stop surface 42*a*.

Figure 3:
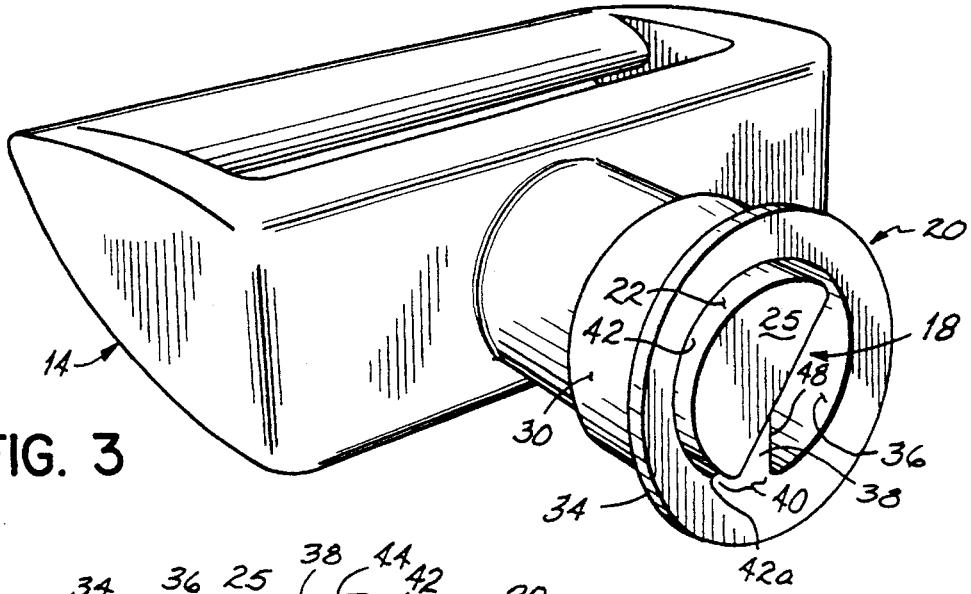
FIG. 3 is a perspective view of the casket handle and anchor member shown engaged with one another.

Turning briefly to FIG. 3, it will be appreciated that connector 18 has been inserted straight into the semi-cylindrical hollow space defined by inner wall 36 and has been rotated to register connector 18 within groove 42 and against stop surface 42*a*. This short twist connection procedure is shown in FIGS. 4–6. FIGS. 4–6 also illustrate the connection of anchor member 20 within a hole 31 in casket side wall 16. Anchor member 20 may be rigidly affixed within hole 31 as by being adhesively secured therein.

As shown in FIG. 4, to connect handle 14 to casket side wall 16, connector 18 is lined up with the inner semi-cylindrical hollow portion defined by inner wall 36 and slid into place in the direction shown. When abutment 28 of handle 42 contacts end wall 32 of anchor member 20 as shown in FIG. 5, inner cam or wedge surface 26 of end wall 25 is disposed outside of and adjacent to cam or wedge surface 44 on the end of semi-cylindrical element 38. When handle 14 is stopped at this position, handle 14 is rotated in the direction indicated by arrow 46 such that connector 18 is rotated into slot 42 while surfaces 26 and 44 wedge and lock against one another. After edge 27 of connector 18 engages stop surface 42*a* of slot 42, as shown in FIGS. 3 and 6, handle 14 is positively stopped and effectively locked by the wedging effect of surfaces 26 and 44 at a predetermined orientation. In the case of a handle 14 as shown in the preferred embodiment, this orientation is with the longest dimension thereof disposed horizontally or in line with the lengthwise dimension of a casket 10 as shown in FIG. 1.

Figure 7:
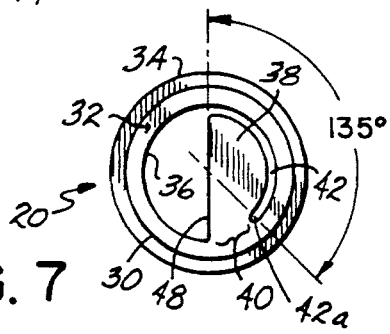
FIG. 7 is an end view of the anchor member showing the twist locking connecting structure thereof; and, FIG. 8 is an end view of the casket handle showing the twist locking connecting structure thereof.
Figure 8:
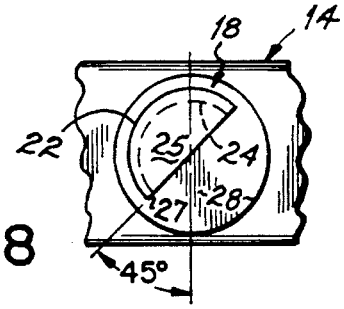

Reference is now made to FIGS. 7 and 8 which more specifically show the angular relationships between the various components which result in the ability to repeatedly connect handle 14 at the same predetermined orientation. As shown in FIG. 7, slot 42 of anchor member 20 extends through an angle of 135° with respect to vertical, with vertical being defined by flat surface 48 of semi-cylindrical element when anchor member 20 is rigidly secured to casket wall 16 (FIGS. 4–6). As further shown in FIG. 8, stop surface 27 of connecting element 18 is disposed at an angle of 45° from vertical when handle 14 is oriented with it lengthwise dimension horizontal or, in other words, at the desired final orientation thereof after being connected to casket 10. It will thus be appreciated that stop surface 27 is disposed at an angle of 135° with respect to horizontal. Therefore, when connecting element 18 is inserted into anchor member 20 and rotated as previously described, stop surface 27 is rotated through an angle of 135° until stop surfaces 27 and 42a engage each other. At this point, handle 14 is disposed in the proper horizontal orientation with respect to casket 10 as shown in FIG. 1.

Although a detailed description of a preferred embodiment has been given above, it will be readily appreciated that many modifications thereof and substitutions of various parts may be made to these details without departing from the spirit and scope of the inventive concepts. For example, many different types of functional and decorative hardware could be attached using connectors falling within the scope of the invention. The specific twist locking connectors shown and described may also take different forms which still allow the hardware to be disconnected from the casket in a short twisting motion without the necessity of accessing the interior of the casket and without the use of tools. Finally, it is contemplated that twist lock connectors which perform the same function as those detailed herein may also be formed in the casket itself.

As many other modifications falling within the inventive concepts disclosed herein are possible, Applicant's intent is not to be bound by the details given, but only by the scope of the appended claims.

What is claimed is:

1. A combination comprising an anchor member for attachment to a casket and an externally removable casket hardware component, said anchor member and said casket hardware component including respective, mating twist locking connectors, said twist locking connectors having stop surfaces engageable and disengageable with each other by a twisting motion of said casket hardware component with respect to said anchor member which is made without accessing an interior of said casket, wherein said stop surfaces define a predetermined angular orientation of said casket hardware component with respect to said anchor member when said anchor member is fixed to said casket, wherein said casket hardware component is a casket handle components, and wherein said anchor member is a generally tubular member sized to receive the twist locking connector of said casket handle component.

2. The combination of claim 1 wherein said anchor member includes a flange for engaging a wall of said casket and restraining the withdrawal of said anchor member from outside said casket.

3. The combination of claim 1 wherein the stop surface of said anchor member is disposed at one end of a slot in said anchor member for receiving a portion of said the twist locking connector of said casket handle component.

4. The combination of claim 3 wherein said twist locking connectors further include respective interfering surfaces which engage each other with a tight fit during said twisting motion.

5. The combination of claim 4 wherein the twist locking connector of said anchor member further comprises a connector element rigidly secured therein and having a curved surface spaced from an inner surface of said anchor member to define said slot.

6. The combination of claim 5 wherein said connector element of said anchor member is generally semi-cylindrical in shape, said anchor member further includes a hollow semi-cylindrical space adjacent to said connector element and said handle component twist locking connector further comprises a hollow semi-cylindrically shaped element sized to be received in a sliding manner within the hollow semi-cylindrical space of said anchor member and twisted into said slot whereupon the connector element of said anchor member is received by the handle component twist locking connector.

7. The combination of claim 6 wherein respective end surfaces of the semi-cylindrical connector element within said anchor member and the hollow semi-cylindrically shaped element further comprise interfering surfaces which engage each other with a tight fit during said twisting motion.

8. The combination of claim 1 wherein said anchor member is formed from a plastic material.

9. The combination of claim 1 wherein the stop surfaces of said twist locking connectors engage one another with less than a full turn of said casket hardware component with respect to said anchor member.

10. The combination of claim 1 wherein said twist locking connectors further include respective interfering surfaces which engage each other with a tight fit during said twisting motion.

11. The combination of claim 1 wherein said casket hardware component is a casket handle and said predetermined orientation is a generally horizontal orientation of a lengthwise dimension of said handle.

12. A combination comprising an anchor member for attachment to a casket and an externally removable casket hardware component, said anchor member and said casket hardware component including respective, mating twist locking connectors, said twist locking connectors having stop surfaces engageable and disengageable with each other by a twisting motion of said casket hardware component with respect to said anchor member which is made without accessing an interior of said casket, wherein said stop surfaces define a predetermined angular orientation of said casket hardware component with respect to said anchor member when said anchor member is fixed to said casket, wherein said anchor member is a generally tubular member sized to receive the twist locking connector of said casket hardware component.

13. The combination of claim 12 wherein the stop surface of said anchor member is disposed at one end of a slot in said anchor member for receiving said the twist locking connector of said casket hardware component.

14. The combination of claim 13 wherein the twist locking connector of said anchor member further comprises a connector element rigidly secured therein and having a curved surface spaced from an inner surface of said anchor member to define said slot.

15. A casket including externally removable casket hardware components, wherein said casket includes a plurality of twist locking connectors rigidly affixed thereto and each of said casket hardware components including a mating twist locking connector, the twist locking connectors of said casket and of said casket hardware components having stop surfaces engageable and disengageable with each other by a twisting motion of said casket hardware component with respect to said casket which is made without accessing an interior of said casket, wherein said stop surfaces define a predetermined angular orientation of said casket hardware component with respect to said casket, wherein said casket hardware component is a casket handle component.

16. The casket of claim 15 wherein said twist locking connectors of said casket are anchor members rigidly within a wall of said casket.

17. The casket of claim 16 wherein said anchor members are formed from a plastic material.

18. The casket of claim 16 wherein each anchor member includes a flange engaging a wall of said casket and restraining the withdrawal of said anchor member from outside said casket.

19. The casket of claim 18 wherein each anchor member is a generally tubular member sized to receive the twist locking connector of said casket handle component.

20. The casket of claim 19 wherein the stop surface of said anchor member is disposed at one end of a slot in said anchor member for receiving a portion of said the twist locking connector of said casket handle component.

21. The casket of claim 20 wherein said twist locking connectors further include respective interfering surfaces which engage each other with a tight fit during said twisting motion.

22. The casket of claim 21 wherein the twist locking connector of said anchor member further comprises a connector element rigidly secured therein and having a curved surface spaced from an inner surface of said anchor member to define said slot.

23. The casket of claim 22 wherein said connector element of said anchor member is generally semi-cylindrical in shape, said anchor member further includes a hollow semi-cylindrical space adjacent to said connector element and said handle component twist locking connector further comprises a hollow semi-cylindrically shaped element sized to be received in a sliding manner within the hollow semi-cylindrical space of said anchor member and twisted into said slot whereupon the connector element of said anchor member is received by the handle component twist locking connector.

24. The casket of claim 23 wherein respective end surfaces of the semi-cylindrical connector element within said anchor member and the hollow semi-cylindrically shaped element further comprise interfering surfaces which engage each other with a tight fit during said twisting motion.

25. The casket of claim 16 wherein the stop surfaces of said twist locking connectors engage one another with less than a full turn of said handle with respect to said anchor member.

26. The casket of claim 15 wherein said twist locking connectors further include respective interfering surfaces which engage each other with a tight fit during said twisting motion.

27. The casket of claim 15 wherein said predetermined orientation is a generally horizontal orientation of a lengthwise dimension of said handle.

* * * * *